US009452604B2

(12) United States Patent
Van Brocklin et al.

(10) Patent No.: US 9,452,604 B2
(45) Date of Patent: Sep. 27, 2016

(54) FLUID LEVEL SENSOR AND RELATED METHODS

(75) Inventors: Andrew L. Van Brocklin, Corvallis, OR (US); Paul A. Liebert, Corvallis, OR (US); Adam L. Ghozeil, Corvallis, OR (US); Scott A. Linn, Corallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 70 days.

(21) Appl. No.: 14/116,269

(22) PCT Filed: Jul. 27, 2011

(86) PCT No.: PCT/US2011/045585

§ 371 (c)(1),
(2), (4) Date: Nov. 7, 2013

(87) PCT Pub. No.: WO2013/015808

PCT Pub. Date: Jan. 31, 2013

(65) Prior Publication Data

US 2014/0085363 A1 Mar. 27, 2014

(51) Int. Cl.

| | |
|---|---|
| ***B41J 2/195*** | (2006.01) |
| ***B41J 29/393*** | (2006.01) |
| ***B41J 2/125*** | (2006.01) |
| ***B41J 2/175*** | (2006.01) |

(Continued)

(52) U.S. Cl.

CPC ..... *B41J 2/125* (2013.01); *B41J 2/0451* (2013.01); *B41J 2/0458* (2013.01); *B41J 2/04555* (2013.01); *B41J 2/14153* (2013.01); *B41J 2/17566* (2013.01)

(58) Field of Classification Search

CPC B41J 2/17566; B41J 2/17513; B41J 2/0451; B41J 2002/14354; B41J 2/0458; B41J 2/14153; B41J 2/04555; B41J 2/125; B41J 29/393

USPC ..... 347/7, 19, 85, 86

See application file for complete search history.

(56) References Cited

U.S. PATENT DOCUMENTS

| | | | | |
|---|---|---|---|---|
| 5,721,574 | A * | 2/1998 | Kubby | 347/7 |
| 7,717,531 | B2 | 5/2010 | Paasch | |
| 2004/0223021 | A1 | 11/2004 | Farr et al. | |

(Continued)

FOREIGN PATENT DOCUMENTS

| | | |
|---|---|---|
| CN | 101559675 A | 10/2009 |
| JP | H10-034938 | 2/1998 |

(Continued)

OTHER PUBLICATIONS

Jia Wei; Silicon MEMS for Detection of Liquid and Solid Fronts; Thesis Delft University of Technology; Jul. 13, 2010; http://repository.tudelft.nl/assets/uuid:2aa6252e-1175-42ec-ab5a-80731af65520/Thesis_JiaWei.pdf.

(Continued)

*Primary Examiner* — Jannelle M Lebron

(74) *Attorney, Agent, or Firm* — HP Inc. Patent Department

(57) ABSTRACT

In an embodiment, a fluid level sensor includes a sensor plate and a current source. The fluid level sensor also includes an algorithm to bias the current source such that current applied to the sensor plate induces a maximum difference in response voltage between a dry sensor plate condition and a wet sensor plate condition.

18 Claims, 13 Drawing Sheets

(51) Int. Cl.
*B41J 2/045* (2006.01)
*B41J 2/14* (2006.01)

(56) References Cited

U.S. PATENT DOCUMENTS

| | | | | |
|---|---|---|---|---|
| 2005/0195248 | A1* | 9/2005 | Nagashima | 347/68 |
| 2006/0061608 | A1* | 3/2006 | Nakayama | 347/10 |
| 2006/0268046 | A1* | 11/2006 | Ootsuka | 347/20 |
| 2007/0040860 | A1 | 2/2007 | Chou et al. | |
| 2007/0153032 | A1 | 7/2007 | Chou et al. | |
| 2009/0128591 | A1* | 5/2009 | Knierim et al. | 347/7 |
| 2010/0245411 | A1 | 9/2010 | Kato et al. | |
| 2011/0018616 | A1 | 1/2011 | Li et al. | |

FOREIGN PATENT DOCUMENTS

| | | | |
|---|---|---|---|
| JP | H11-010901 | | 1/1999 |
| JP | 2001-146022 | | 5/2001 |
| JP | 2007253402 | A | 10/2007 |
| JP | 2011088293 | A | 5/2011 |
| KR | 20030047331 | | 6/2003 |
| WO | WO-2010089234 | | 8/2010 |

OTHER PUBLICATIONS

Miikka Yimaula et al; Monolithic SOI-MEMS Capacitive Pressure Sensor with Standard Bulk CMOS Readout Circuit; VTT Information Technology, Microelectronics; Finland; pp. 1-4.

* cited by examiner

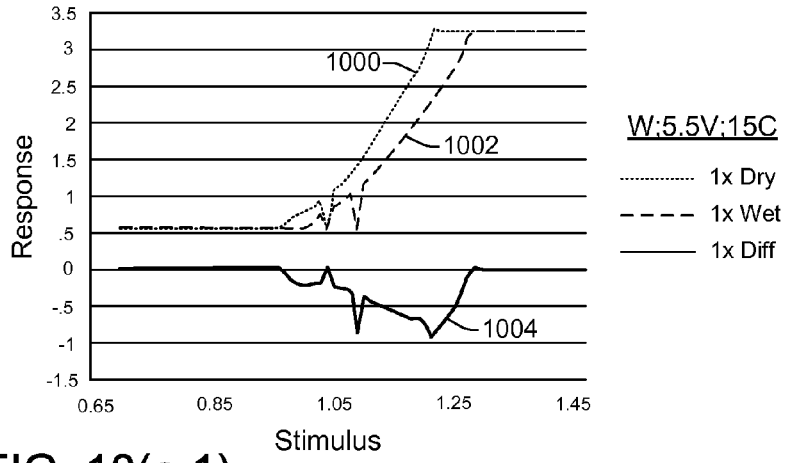
FIG. 10(a.1)
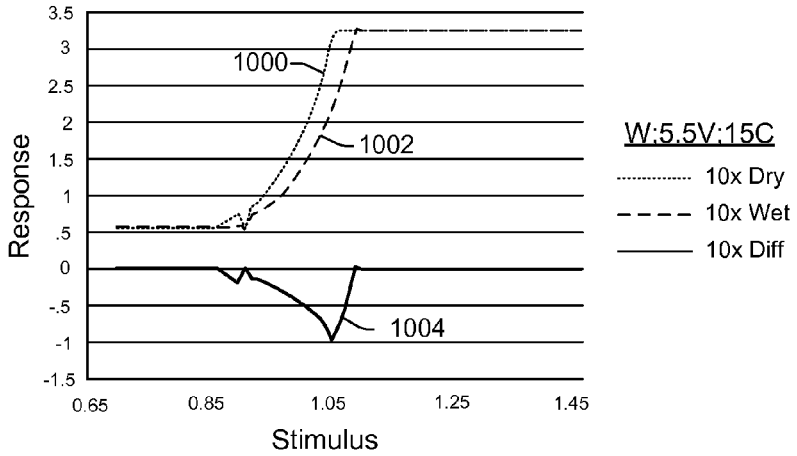
FIG. 10(a.2)
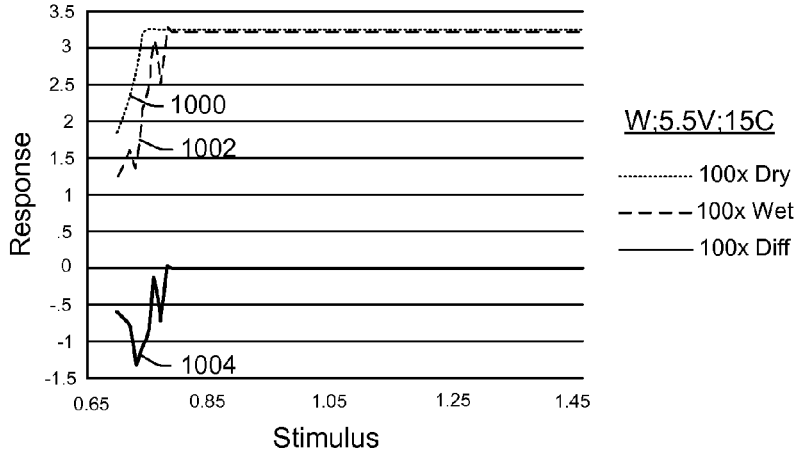
FIG. 10(a.3)

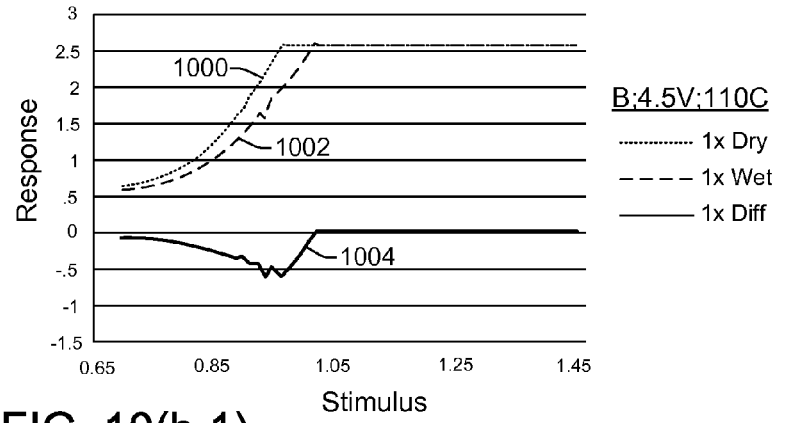
FIG. 10(b.1)
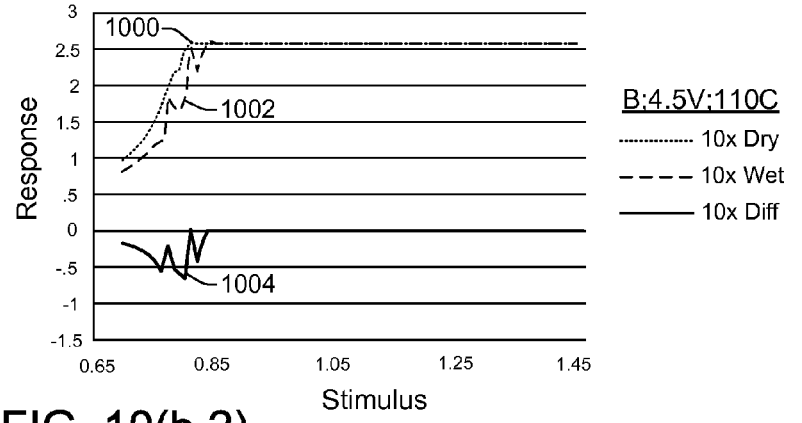
FIG. 10(b.2)
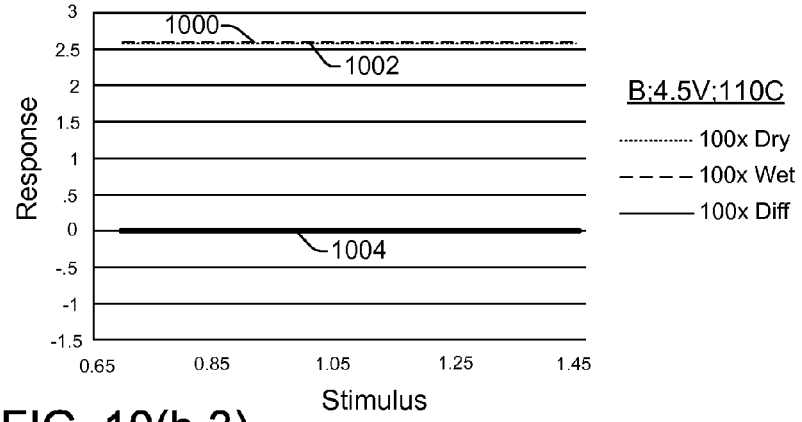
FIG. 10(b.3)

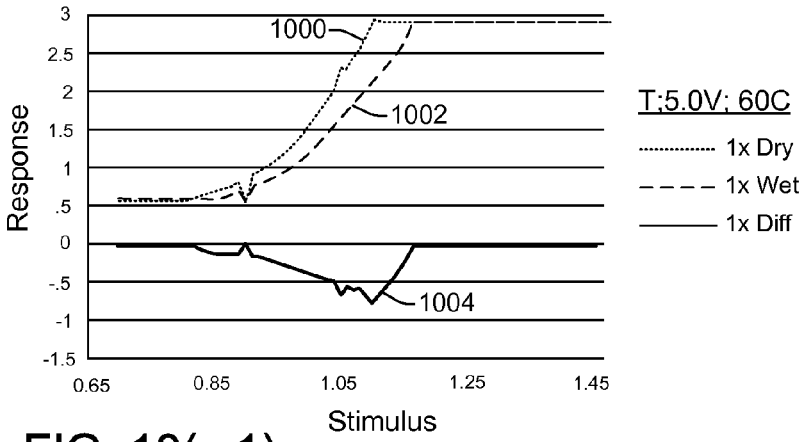
FIG. 10(c.1)
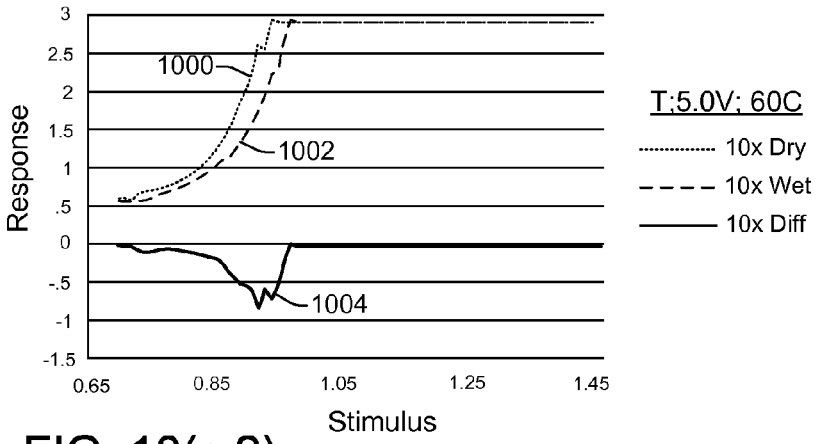
FIG. 10(c.2)
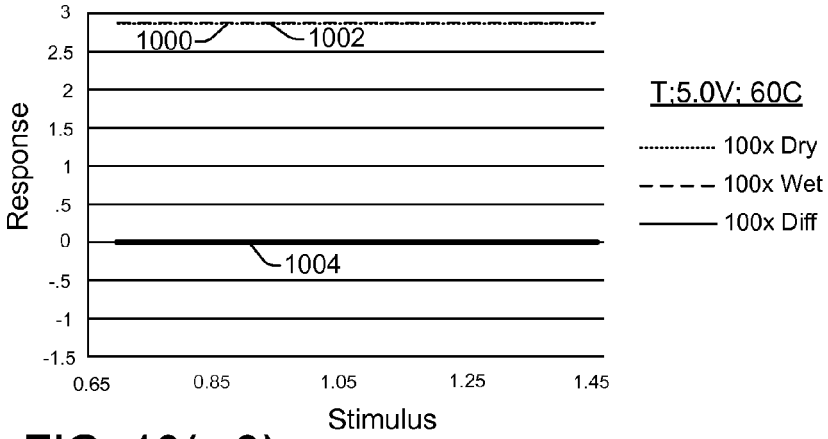
FIG. 10(c.3)

FLUID LEVEL SENSOR AND RELATED METHODS

BACKGROUND

Accurate ink level sensing in ink supply reservoirs for various types of inkjet printers is desirable for a number of reasons. For example, sensing the correct level of ink and providing a corresponding indication of the amount of ink left in A fluid cartridge allows printer users to prepare to replace depleted ink cartridges. Accurate ink level indications also help to avoid wasting ink, since inaccurate ink level indications often result in the premature replacement of ink cartridges that still contain ink. In addition, printing systems can use ink level sensing to trigger certain actions that help prevent low quality prints that might result from inadequate supply levels.

While there are a number of techniques available for determining the level of fluid in a reservoir, or a fluidic chamber, various challenges remain related to their accuracy and cost.

BRIEF DESCRIPTION OF THE DRAWINGS

The present embodiments will now be described, by way of example, with reference to the accompanying drawings, in which:

FIG. 10 shows examples of process and environmental variations affecting weak wet and dry response curves, according to an embodiment;

DETAILED DESCRIPTION

Overview of Problem and Solution

Figure 1:
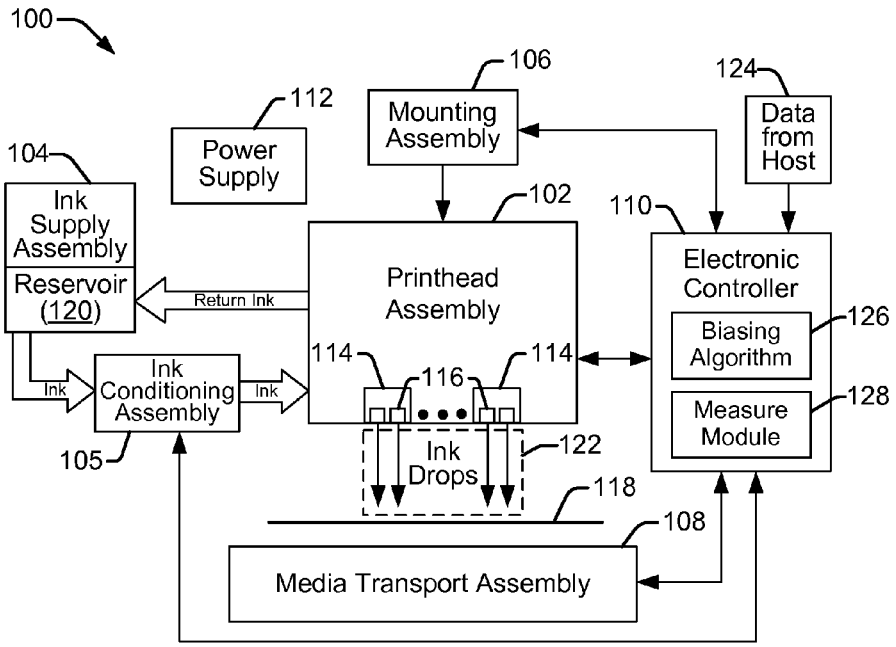
FIG. 1 shows a fluid ejection device embodied as an inkjet printing system suitable for incorporating a fluid level sensor, according to an embodiment.

As noted above, there are a number of techniques available for determining the level of fluid in a reservoir or fluidic chamber. For example, prisms have been used to reflect or refract light beams in ink cartridges to generate electrical and/or user-viewable ink level indications. Backpressure indicators are another way to determine fluid levels in a reservoir. Some printing systems count the number of drops ejected from inkjet print cartridges as a way of determining ink levels. Still other techniques use the electrical conductivity of the fluid as a level indicator in printing systems. Challenges remain, however, regarding improving the accuracy and cost of fluid level sensing systems and techniques.

Embodiments of the present disclosure provide a fluid level sensor and related methods that improve on prior ink level sensing techniques. The disclosed sensor and methods include a MEMS structure with fluidic elements, a sensor circuit, and a biasing technique to bias the circuit at an optimum operating point. The operating point at which the circuit is biased enables a maximum output difference signal between a dry ink condition (i.e., no ink present) and a wet ink condition (i.e., ink present). The sensor circuit includes a sensor plate in a fluidic channel. Backpressure exerted on the ink in the channel (e.g., while spitting or priming) retracts the ink from a nozzle and pulls it back through the channel over the sensor plate, exposing the plate to air. The circuit includes a current source to supply a current to the sensor plate and induce a voltage response across the plate. The voltage response measured across the plate provides an indication of whether the plate is wet (i.e., indicating ink is present in the fluidic channel) or dry (i.e., indicating air is present in the fluidic channel). The biasing technique employs an algorithm to bias the current source at an optimum point where the amount of current supplied to the sensor plate induces a maximum differential voltage response across the sensor plate between the wet and dry plate conditions in weak signal conditions.

Advantages of the disclosed fluid level sensor and related methods include a high tolerance to contamination from debris left behind in the MEMS structure (e.g., fluidic channels and ink chambers) that enables accurate indications between wet and dry conditions. The sensor cost is controlled because of its use of circuitry and MEMS structures placed onto an existing thermal ink jet print head. The size of the circuitry is such that it can be placed in the space of a few ink-jet nozzles.

In one embodiment, a fluid level sensor includes a sensor circuit having a sensor plate and a current source. The fluid level sensor also includes an algorithm having processor-executable instructions to bias the current source such that current applied to the sensor plate from the current source induces a maximum difference in response voltage between a dry sensor plate condition and a wet sensor plate condition.

In one embodiment, a fluid level sensor includes a current source and a DAC (digital-to-analog convertor) to convert an input code into a bias voltage for the current source. The sensor also includes a sensor plate and a switch to apply current from the current source to the sensor plate. A measurement module determines a wet or dry sensor plate condition by comparing a response voltage on the sensor plate to a threshold.

In another embodiment, a method of sensing a fluid level includes applying stimulus voltage to a sensor circuit in wet and dry conditions. The stimulus voltage has a range from a minimum to a maximum voltage. The method includes measuring a wet response and a dry response over the stimulus range. A difference response between the wet and dry responses is determined, and a peak difference is located in the difference response. The method then determines a peak stimulus voltage that corresponds to the peak difference.

In another embodiment, a method of sensing a fluid level includes biasing a current source such that a current will induce a maximum voltage variation across a sensor plate between a wet sensor plate condition and a dry sensor plate condition. The method also includes applying the current to the sensor plate, sampling a response voltage across the sensor plate, comparing the response voltage to a threshold voltage, and determining the dry sensor plate condition based on the comparing.

Illustrative Embodiments

FIG. 1 illustrates a fluid ejection device embodied as an inkjet printing system 100 suitable for implementing a fluid level sensor and methods as disclosed herein, according to an embodiment of the disclosure. In this embodiment, a fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 can be any type of suitable sheet or roll material, such as paper, card stock, transparencies, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, ink supply assembly 104 supplies ink under positive pressure through an ink conditioning assembly 105 to inkjet printhead assembly 102 via an interface connection, such as a supply tube. Ink supply assembly 104 includes, for example, a reservoir 120, pumps and pressure regulators (not specifically illustrated). Reservoir 120 may be removed, replaced, and/or refilled. Conditioning in the ink conditioning assembly 105 may include filtering, preheating, pressure surge absorption, and degassing. Ink is drawn under negative pressure from the printhead assembly 102 to the ink supply assembly 104. The pressure difference between the inlet and outlet to the printhead assembly 102 is selected to achieve the correct backpressure at the nozzles 116, and is usually a negative pressure between negative 1" and negative 10" of H2O. However, as the ink supply (e.g., in reservoir 120) nears its end of life, the backpressure exerted during printing or priming operations increases. The increased backpressure is strong enough to retract the ink meniscus from the nozzle 116 and back through the fluidic channel of the MEMS structure. In one embodiment, printhead 114 includes an ink level sensor 206 (FIG. 2) that uses the increased backpressure and retracted meniscus to provide an accurate ink level indication toward the end of life of the ink supply.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108 while media transport assembly 108 positions print media 118 relative to inkjet printhead assembly 102.

Electronic printer controller 110 typically includes a processor, firmware, software, one or more memory components including volatile and no-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters from data 124. In one embodiment, electronic controller 110 includes a biasing algorithm 126 having executable instructions to execute on controller 110. The biasing algorithm 126 executes to control the ink level sensor 206 (FIG. 2) and to determine an optimum operating/bias point that produces a maximum voltage response difference from the sensor 206 between a wet condition (i.e., when ink is present) and a dry condition (when air is present). Electronic controller 110 additionally includes a measurement module 128 having executable instructions to execute on controller 110. After an optimum bias point is determined, measurement module 128 executes to initiate a measurement cycle that controls the ink level sensor 206 and determines an ink level based on a measured time period during which a dry condition persists in a fluidic channel of the MEMS structure.

In the described embodiments, inkjet printing system 100 is a drop-on-demand thermal inkjet printing system with a thermal inkjet (TIJ) printhead 114 suitable for implementing an ink level sensor as disclosed herein. In one implementation, inkjet printhead assembly 102 includes a single TIJ printhead 114. In another implementation, inkjet printhead assembly 102 includes a wide array of TIJ printheads 114.

While the fabrication processes associated with TIJ printheads are well suited to the integration of the disclosed ink level sensor, other printhead types such as a piezoelectric printhead can also implement such an ink level sensor. Thus, the disclosed ink level sensor is not limited to implementation in a TIJ printhead 114.

Figure 2:
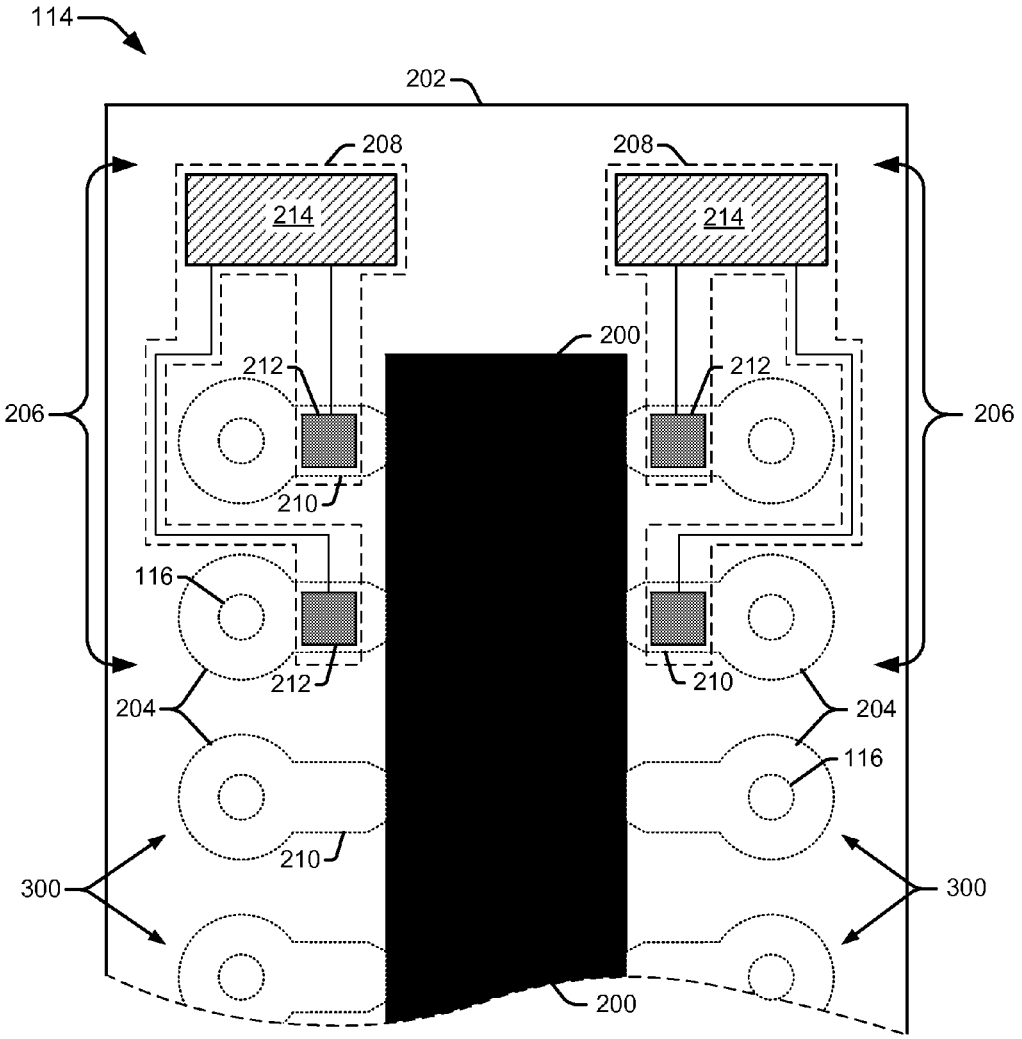
FIG. 2 shows a bottom view of one end of a TIJ printhead having a single fluid slot formed in a silicon die substrate, according to an embodiment.

FIG. 2 shows a bottom view of one end of a TIJ printhead 114 having a single fluid slot 200 formed in a silicon die substrate 202, according to an embodiment of the disclosure. Although printhead 114 is shown with a single fluid slot 200, the principles discussed herein are not limited in their application to a printhead with just one slot 200. Rather, other printhead configurations are also possible, such as printheads with two or more fluid slots, or printheads that use various sized holes to bring ink to fluidic channels and chambers. The fluid slot 200 is an elongated slot formed in the substrate 202 that is in fluid communication with a fluid supply, such as a fluid reservoir 120. Fluid slot 200 has fluid drop generators 300 arranged along both sides of the slot that include fluid chambers 204 and nozzles 116. Substrate 202 underlies a chamber layer having fluid chambers 204 and a nozzle layer having nozzles 116 formed therein, as discussed below with respect to FIG. 3. However, for the purpose of illustration, the chamber layer and nozzle layer in FIG. 2 are assumed to be transparent in order to show the underlying substrate 202. Therefore, chambers 204 and nozzles 116 in FIG. 2 are illustrated using dashed lines.

In addition to drop generators 300 arranged along the sides of the slot 200, the TIJ printhead 114 includes one or more fluid (ink) level sensors 206. A fluid level sensor 206 generally includes a MEMS structure and an integrated sensor circuit 208. A MEMS structure includes, for example, fluid slot 200, fluidic channels 210, fluid chambers 204 and nozzles 116. A sensor circuit 208 includes a sensor plate 212 located on the floor of a fluidic channel 210, and other circuitry 214. The other circuitry 214 includes, for example, a current source, a buffer amplifier, a DAC (digital-to-analog convertor), an ADC (analog-to-digital convertor), and measurement circuitry. The sensor plate 212 is a metal plate formed, for example, of tantalum. Portions of the other circuitry 214, such as the ADC and measurement circuitry, may not all be in one location on substrate 202, but instead may be distributed on substrate 202 in different locations. The fluid sensor 206 and sensor circuit 208 are discussed in greater detail below with respect to FIGS. 4 and 5.

Figure 3:
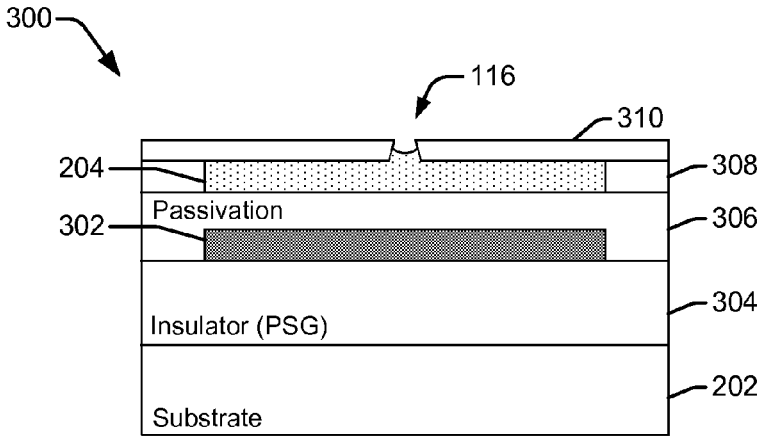
FIG. 3 shows a cross-sectional view of an example fluid drop generator, according to an embodiment.

FIG. 3 shows a cross-sectional view of an example fluid drop generator 300, according to an embodiment of the disclosure. Each drop generator 300 includes a nozzle 116, a fluid chamber 204, and a firing element 302 disposed in the fluid chamber 204. Nozzles 116 are formed in nozzle layer 310 and are generally arranged to form nozzle columns along the sides of the fluid slot 200. Firing element 302 is a thermal resistor formed of a metal plate (e.g., tantalum-aluminum, TaAl) on an insulating layer 304 (e.g., polysilicon glass, PSG) on a top surface of the silicon substrate 202. A passivation layer 306 over the firing element 302 protects the firing element from ink in chamber 204 and acts as a mechanical passivation or protective cavitation barrier structure to absorb the shock of collapsing vapor bubbles. A chamber layer 308 has walls and chambers 204 that separate the substrate 202 from the nozzle layer 310.

During printing, a fluid drop is ejected from a chamber 204 through a corresponding nozzle 116, and the chamber 204 is then refilled with fluid circulating from fluid slot 200. More specifically, an electric current is passed through a resistor firing element 302 resulting in rapid heating of the element. A thin layer of fluid adjacent to the passivation layer 306 that covers firing element 302 is superheated and vaporizes, creating a vapor bubble in the corresponding firing chamber 204. The rapidly expanding vapor bubble forces a fluid drop out of the corresponding nozzle 116. When the heating element cools, the vapor bubble quickly collapses, drawing more fluid from fluid slot 200 into the firing chamber 204 in preparation for ejecting another drop from the nozzle 116.

Figure 4:
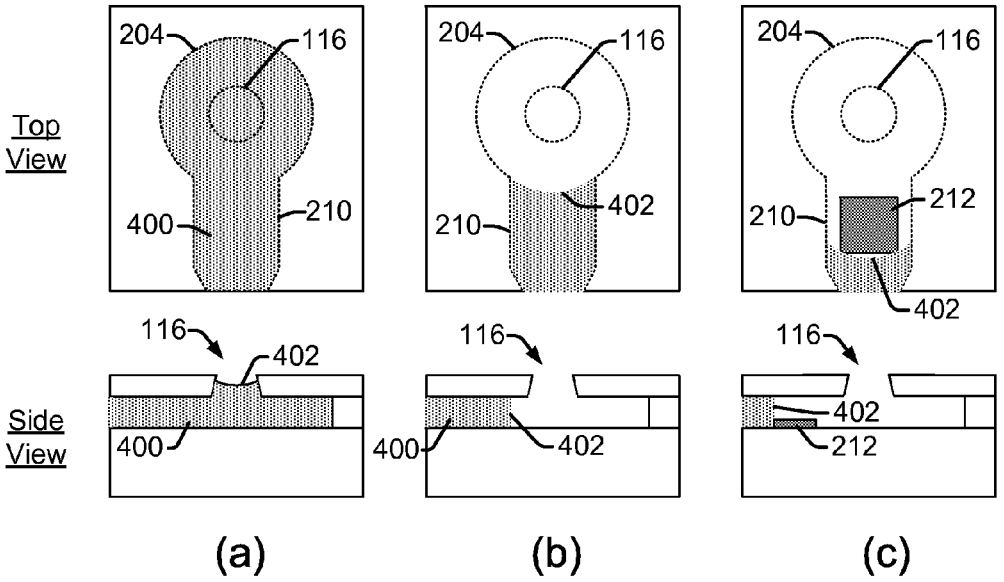
FIG. 4 shows partial top and side views of a MEMS structure in different stages as ink is retracted over the sensor plate during a priming operation, according to an embodiment.

FIG. 4 shows partial top and side views of a MEMS structure in different stages as ink is retracted over the sensor plate during a priming operation, according to an embodiment of the disclosure. As noted above, a fluid level sensor 206 generally includes a MEMS structure having a fluidic channel 210, a fluid chamber 204 and a dedicated sensor nozzle 116. A fluid level sensor 206 also includes a sensor circuit 208 with a sensor plate 212 located on the floor of a fluidic channel 210. The sensor circuit 208 operates to detect the presence or absence of fluid (ink) in the fluidic channel during a priming operation. As the ink supply in reservoir 120 nears its end of life, the backpressure exerted during printing or priming operations becomes strong enough to retract the ink meniscus from the nozzle 116 and back through the fluidic channel 210, exposing the sensor plate 212 to air. FIG. 4(*a*) shows a normal state where ink 400 fills the chamber 204 and forms an ink meniscus 402 within the nozzle 116. In this state, the sensor plate 212 is in a wet condition as it is covered with the ink that fills the fluidic channel 210. During a priming operation, or a normal ink drop ejection printing operation, a backpressure is exerted on the ink in the fluidic channel 210 which retracts the ink meniscus 402 from the nozzle and pulls it back within the channel as shown in FIG. 4(*b*). As the ink supply in reservoir 120 nears its end of life, this backpressure increases, as does the time it takes for the ink to flow back into the channel 210 and nozzle 116. As shown in FIG. 4(*c*), the increased backpressure pulls the ink meniscus far enough back into the channel 210 that the sensor plate 212 is exposed to air drawn in through nozzle 116. As discussed below, the sensor circuit 208 uses the exposed sensor plate 212 to determine an accurate ink level near the end of life of the ink supply.

Figure 5:
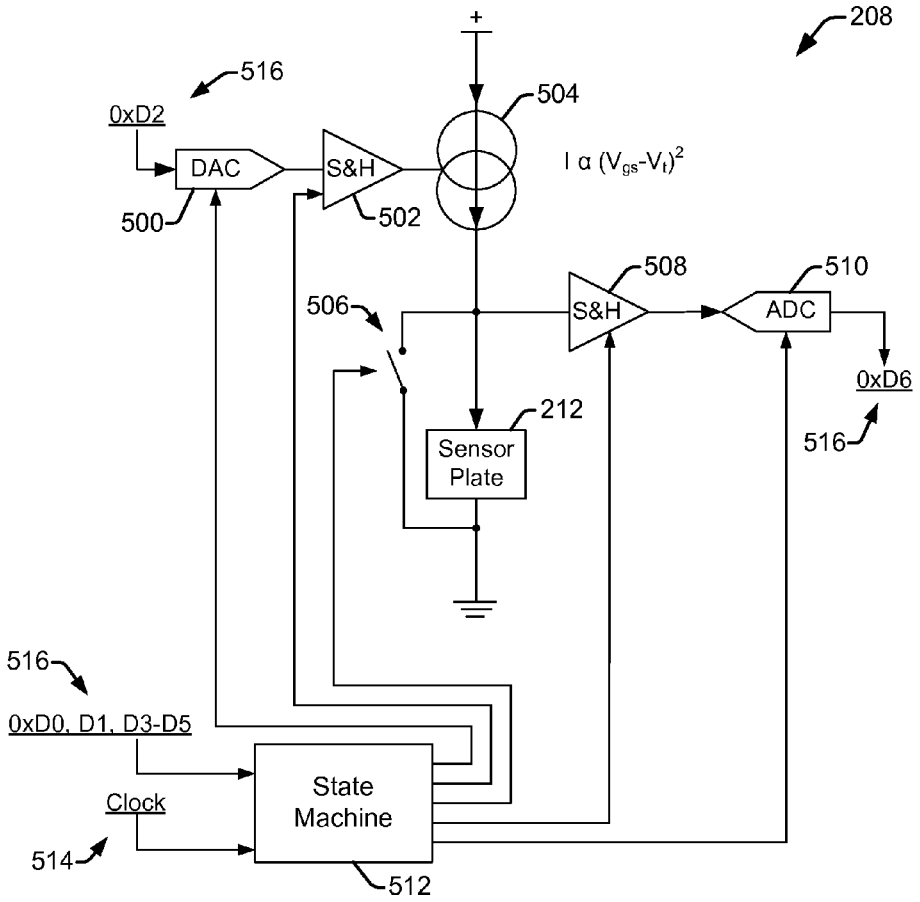
FIG. 5 shows an example of a high level block diagram of an ink level sensor circuit, according to an embodiment.

FIG. 5 shows an example of a high level block diagram of a fluid level sensor circuit 208, according to an embodiment of the disclosure. The sensor circuit 208 includes a DAC (digital-to-analog convertor) 500, an input S&H (sample and hold element) 502, a current source 504, a sensor plate 212, a switch 506, an output S&H 508, an ADC (analog-to-digital convertor) 510, a state machine 512, a clock 514, and a number of registers such as registers 0xD0-0xD6, 516. Operation of the sensor circuit 208 begins with configuring (i.e., biasing) the current source 504 with the DAC 500 and input S&H 502 while switch 506 is closed to short out the sensor plate 212. The biasing algorithm 126, discussed in greater detail below, executes on controller 110 to determine a stimulus (input code) to apply to register 0xD2 that yields an optimum bias voltage from the DAC 500 with which to bias the current source 504.

After the current source 504 is biased, the measurement module 128 executes on controller 110 and initiates a fluid level measurement cycle during which it controls the sensor circuit 208 through state machine 512. When it is time to measure, the state machine 512 coordinates the measurement by stepping the circuit 208 through several stages that prepare the circuit, take the measurements, and return the circuit to idle. In a first step, the state machine 512 initiates a priming event. The priming event spits or ejects ink from the nozzle 116 to clear the nozzle and chamber 204 of ink, and creates a backpressure spike in the fluidic channel 210.

The state machine 512 then provides a delay period. The delay period is variable, but typically lasts on the order of between 2 and 32 microseconds. After the delay, a first circuit preparation step opens switch 506, applying current from the current source 504 to the sensor plate 212. The applied current charges the plate capacitance and induces a voltage response across the plate.

Figure 6:
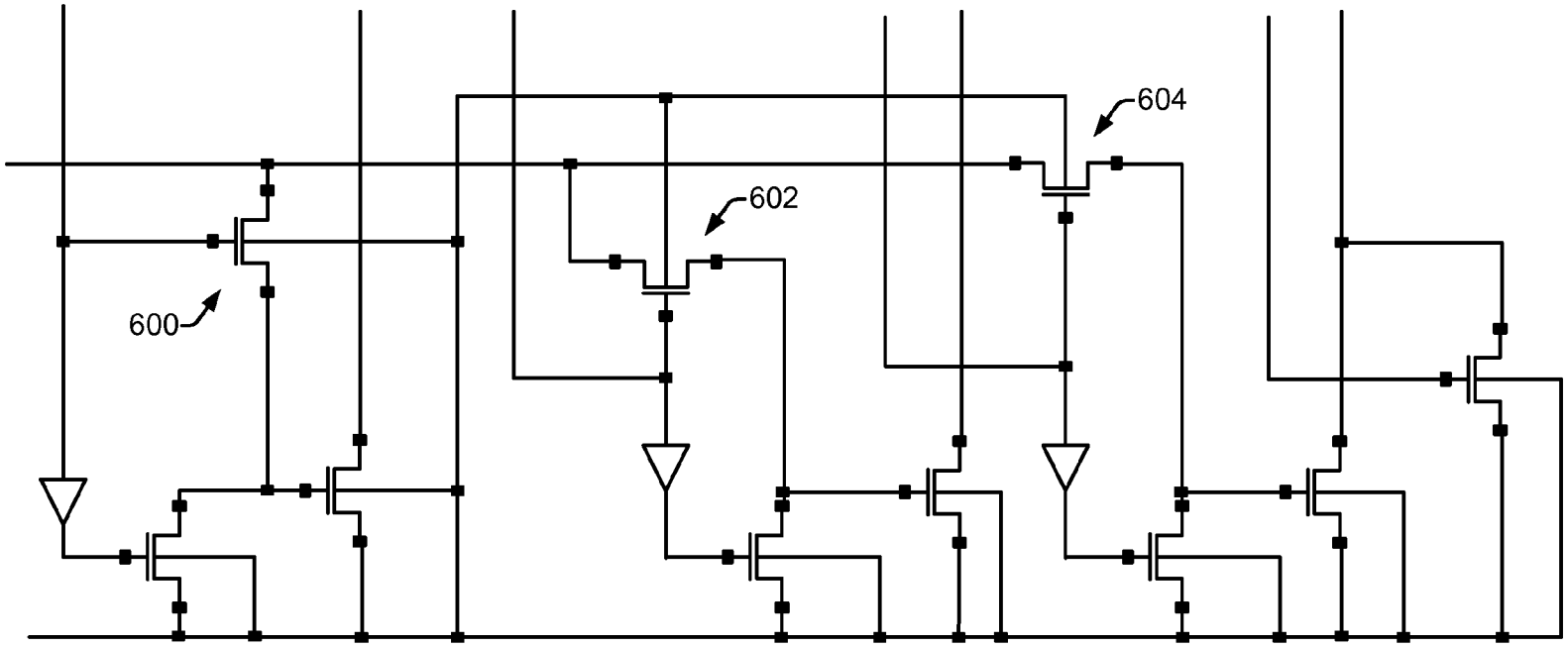
FIG. 6 shows a range select circuit, according to an embodiment.

Note that the current supplied from the current source 504 is based on the following relationship:

$$I\alpha(V_{gs}-V_t)^2$$

where Vgs is the bias voltage from the DAC 500. Vgs is the gate-to-source voltage and Vt is the gate threshold voltage of a current-producing transistor of the current source 504. Current source 504 includes a range select circuit, shown generally in FIG. 6, that enables the voltage from the DAC 500 to be applied to one of three current-producing transistors 600, 602, 604, that produce current for the ranges 1×, 10× and 100×. Once a transistor is selected to produce current, the voltage from the DAC 500 is applied at the gate of the selected transistor which determines the amount of current supplied by current source 504.

In a second circuit preparation step, the state machine 512 opens the switch 506 and provides a second delay period, which again lasts on the order of between 2 and 32 microseconds. After the second delay, the state machine 512 causes the output S&H element 508 to sample (i.e., measure) the analog response voltage at the sensor plate 212 and to hold it. The state machine 512 then initiates a conversion through ADC 510 that converts the sampled analog response voltage to a digital value that is stored in a register, 0xD6. The register holds the digital response voltage until the measurement module 128 reads the register. The circuit 208 is then put in an idle mode until another measurement cycle is initiated.

The measurement module 128 compares the digitized response voltage to an $R_{detect}$ threshold to determine if the sensor plate is in a dry condition. If the measured response exceeds $R_{detect}$ then the dry condition is present. Otherwise the wet condition is present. (Calculation of the $R_{detect}$ threshold is discussed below). Detecting a dry condition indicates that the backpressure has pulled the ink in the fluidic channel 210 back far enough to expose the sensor plate 212 to air. Through additional measurement cycles, the length of time that the dry condition persists (i.e., while the sensor plate is exposed to air) is measured and used to interpolate the magnitude of backpressure creating the dry condition. Since the backpressure increases predictably toward the end of the life of the ink supply, an accurate determination of the ink level can then be made.

Figure 7:
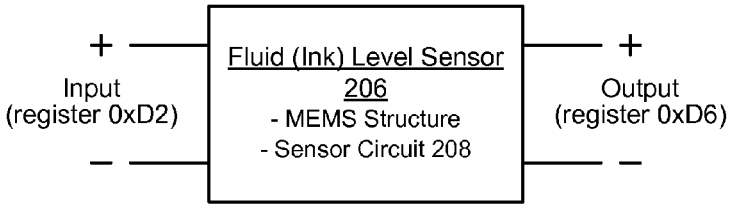
FIG. 7 shows an ink level sensor as a black box element, according to an embodiment.

As noted above, the biasing algorithm 126 executes on controller 110 to determine an optimum bias voltage from the DAC 500 with which to bias the current source 504. The biasing algorithm 126 controls the fluid level sensor 206 (i.e., the sensor circuit 208 and MEMS structure) while determining the bias voltage. From the perspective of the biasing algorithm 126, as shown in FIG. 7, the fluid level sensor 206 is a black box element that receives an input or stimulus and provides an output or response. An input voltage is set using a 0-255 (8-bit) number (input code) applied to register 0xD2 of sensor circuit 208. The input number or code in register 0xD2 is a stimulus that is applied to the DAC 500, and the analog voltage output from the DAC is the stimulus multiplied by 10 mV. Therefore, the range of analog bias voltage from the DAC 500 that is available for biasing the current source 504 is 0-2.55V. The output or response from the sensor circuit 208 is a digital code stored in an 8-bit register 0xD6.

Figure 8:
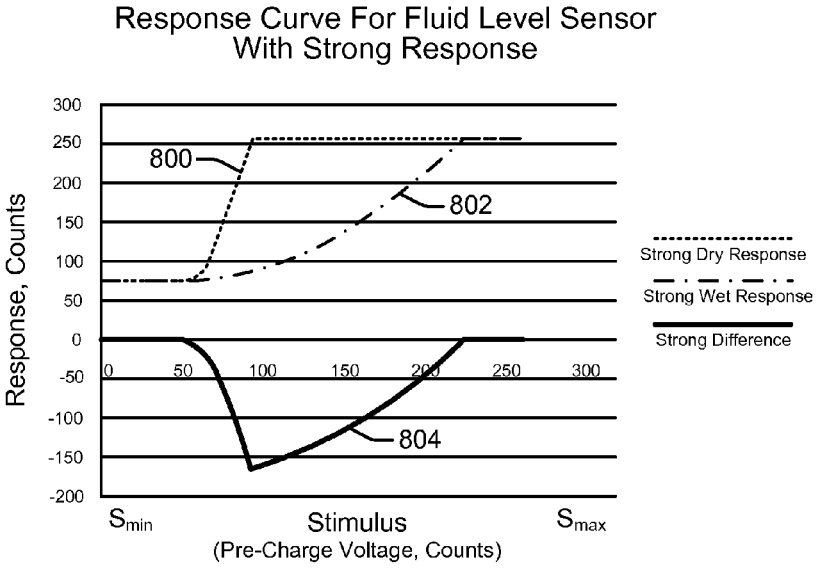
FIG. 8 shows a dry response curve, a wet response curve, and a difference curve over a range of input stimulus, according to an embodiment.

The biasing algorithm uses the stimulus-response relationship of the sensor circuit 208 between input codes and output codes to provide an optimum output delta signal (i.e., a maximum response voltage) between when the sensor plate 212 is wet (i.e., when ink is present in MEMS fluidic channel 210 and covers the plate) and when the sensor plate 212 is dry (i.e., when ink has been pulled out of the MEMS fluidic channel 210 and air surrounds the plate). As shown in FIG. 8, when the stimulus (input codes) is swept from its minimum to its maximum pre-charge voltage count (i.e., 0-255; $S_{min}$ to $S_{max}$), the response (output codes) generate response waveforms that progress through three distinct regions: Off, Active and Saturated. Together, the three regions form the shape of a lazy "S". FIG. 8 shows a dry response curve 800, a wet response curve 802, and a difference curve 804 that indicates the difference between the wet and dry response curves over the range of input stimulus. The FIG. 8 response curves depict favorable conditions where the responses are strong. In general, the largest signal delta (i.e., largest difference response curve) occurs between the case where the sensor plate 212 is fully wet with a full channel of ink, and the case where the sensor plate 212 is fully dry with full contact with air in the channel.

Figure 9:
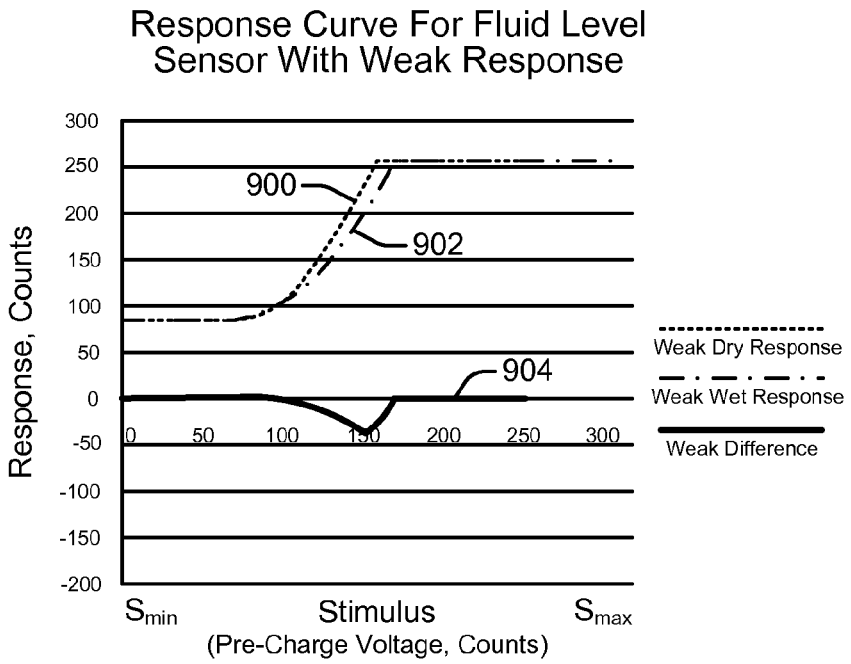
FIG. 9 shows a weak dry response curve, a weak wet response curve, and a weak difference curve, according to an embodiment.

Although the response curves vary between the presence and absence of fluid/ink (i.e., between wet and dry conditions), the amount of variance is stronger when there is little or no contamination present in the MEMS structure, such as conductive debris and ink residue. Therefore, the response is initially strong as shown by the strong response curves in FIG. 8. However, over time the MEMS structure may become contaminated with ink residue in the fluidic channels and chambers, and the dry response in particular will degrade and become closer to the wet response. Contamination causes conduction in the dry case that makes the dry response weak, which results in a weak difference between the dry and wet response. FIG. 9 shows weak dry 900, wet 902, and difference 904 response curves where unfavorable conditions such as contamination in the MEMS structure have degraded the responses. As can be seen in FIG. 9, the difference between the weak wet and weak dry response curves is much less than the difference shown in the strong response curves of FIG. 8. The strong difference curve 804 shown in FIG. 8 provides a strong distinction between a wet and dry condition that can be readily evaluated. However, under weak response conditions, finding a distinction between wet and dry conditions is more challenging because of the weak difference. The biasing algorithm 126 finds the optimum point of difference in the weak response difference curve 904 (i.e., shown in FIG. 9) where fluid/ink level measurements will provide the maximum response between wet and dry conditions.

FIGS. 10 (*a*.1, *a*.2, *a*.3, *b*.1, *b*.2, *b*.3, *c*.1, *c*.2, *c*.3) show examples of weak dry response curves 1000 and weak wet response curves 1002 and their variations in response to differences in process and environmental conditions, such as manufacturing process, supply voltage and temperature (PV&T), according to an embodiment of the disclosure. FIGS. 10(*a*.1), (*a*.2) and (*a*.3) show example curves over input stimulus ranges 1×, 10× and 100×, respectively, with worst (W) case processing conditions, a 5.5 volt supply, and 15 degrees centigrade temperature (referenced in FIGs. as "W;5.5V;15C"). FIGS. 10(*b*.1), (*b*.2) and (*b*.3) show example curves over input stimulus ranges 1×, 10× and 100×, respectively, with best case (B) processing conditions, a 4.5 volt supply, and 110 degrees centigrade temperature (referenced in FIGs. as "B;4.5V;110C"). FIGS. 10(*c*.1), (*c*.2) and (*c*.3) show example curves over input stimulus ranges 1×, 10× and 100×, respectively, with typical (T) processing conditions, a 5.0 volt supply, and 60 degrees centigrade temperature (referenced in FIGs. as "T;5.0V;60C"). In some cases, the active regions of the response curves change in slope due to variations in PV&T. In other cases, the active regions of the response curves shift their placement, starting earlier or later in the off region. The dry and wet response curves in FIGS. 10 (*a*), (*b*) and (*c*), show such variations in slopes and starting points that can result from varying PV&T conditions. The difference curves 1004 in FIGS. 10 (*a*), (*b*) and (*c*), show the difference between the wet and dry response curves over the range of input stimulus and over variations in PV&T conditions.

Figure 11:
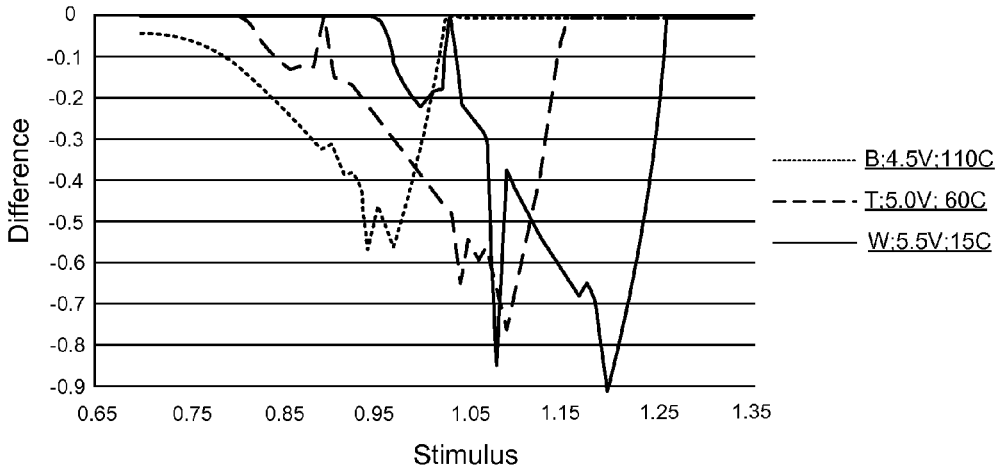
FIG. 11 overlays the wet-dry difference signals from FIG. 10 and shows the difference plotted against the stimulus, illustrating shifts caused by process and environment, according to an embodiment.

FIG. 11 shows the difference between the dry response and wet response plotted against the stimulus, according to an embodiment of the disclosure. The difference curves 1004 shown in FIG. 10 are overlayed to form FIG. 11. The intention is to illustrate that the height of the peak of the difference curves, the slope of the approach and decay of the curves, and the placement of the center of the stimulus axis along the curves, all vary across PV&T.

Figure 12:
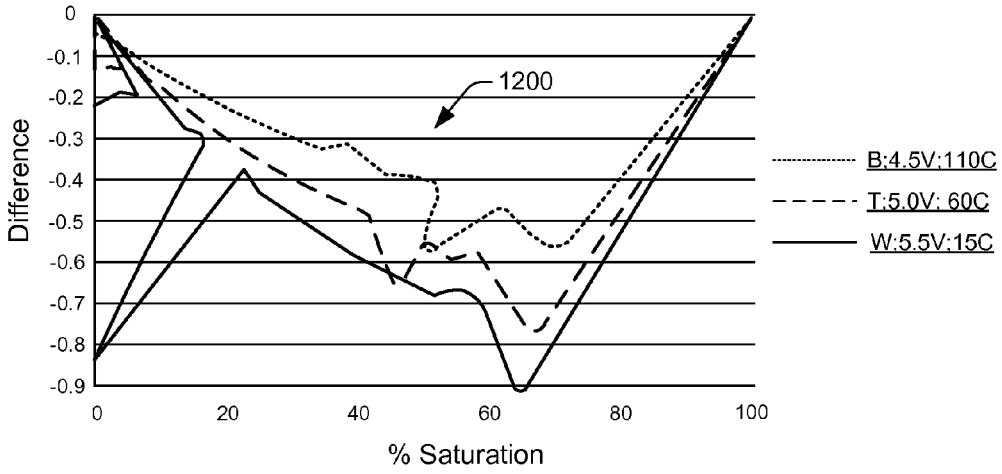
FIG. 12 shows difference signal curves based on response instead of on stimulus, according to an embodiment.

FIG. 12 shows an example of composite difference curves 1200 plotted against the wet response, according to an embodiment of the disclosure. By shifting the basis of the difference curves to response, instead of stimulus, a measure of isolation from PV&T differences is achieved. The biasing algorithm 126 finds a solution where the optimum difference point is located in the weak difference case that provides a maximum ink level measurement response between wet and dry conditions. Therefore, the solution should be tolerant to such variations in PV&T, as well as provide as large a margin as possible. Accordingly, as shown in FIG. 12, a large amount of the PV&T variance can be removed by viewing the difference curve 1004 as a function of the wet response curve 1002, instead of as a function of the input stimulus. This is because there is a large variation in output value for a given stimulus over process, voltage and temperature (PV&T). However, the difference between the dry condition (no ink) and the wet condition (ink present) does not vary as much over PV&T, so using this difference subtracts off much of the PV&T-induced variation. The composite of the difference curves encompasses the area formed by overlaying many difference curves determined across all process and environmental (PV&T) conditions. Thus, the region above the composite difference represents viable signal response area that is independent of PV&T conditions. The center of the composite difference represents the location where ink level measurements should be made in order to achieve a peak response ($R_{peak}$) that maximizes the voltage response between a dry condition and a wet condition. The location of the $R_{peak}$ response is expressed as a percentage of the span between the minimum and maximum wet response, $R_{min}$ and $R_{max}$. Thus, the location of $R_{peak}$ on the composite difference curve 1200 is called $R_{pd\ \%}$. In addition, during a measurement cycle, the height of the peak of the composite difference curve 1200 at location $R_{pd\ \%}$ represents the minimum difference expected (as a percentage of the span between $R_{min}$ and $R_{max}$) when the dry condition is present, and can be called $D_{min\ \%}$.

The biasing algorithm 126 determines an input stimulus value $S_{peak}$, that produces the peak response $R_{peak}$ located on the composite difference curve 1200 at Rpd %. The algorithm inputs a minimum stimulus ($S_{min}$) at register 0xD2 and samples the response in register 0xD6. The algorithm also inputs a maximum stimulus ($S_{max}$) at register 0xD2 and samples the response in register 0xD6. These two values in register 0xD6 are the extremes of response, $R_{min}$ and $R_{max}$ respectively. The peak response value $R_{peak}$ can then be calculated as follows:

$$R_{peak}=R_{min}+(R_{pd\ \%}*(R_{max}-R_{min}))$$

The corresponding stimulus value, $S_{peak}$, can then be found by a variety of approaches. The stimulus can, for example, be swept from $S_{min}$ to $S_{max}$, stopping when the response reaches $R_{peak}$. Another approach is to use a binary search. The stimulus value $S_{peak}$ that produces the peak response $R_{peak}$ is the input code applied to register 0xD2 to optimally bias the current source 504 in sensor circuit 208 such that a maximum response can be measured across the sensor plate 212 between a dry plate condition and a wet plate condition.

As noted above, in a measurement cycle the measurement module 128 determines if the sensor plate 212 is in a dry condition by comparing the response voltage measured across the plate to an $R_{detect}$ threshold. If the measured response exceeds $R_{detect}$ then the dry condition is present. Otherwise the wet condition is present. The $R_{detect}$ threshold is calculated by the following equation:

$$R_{detect}=R_{peak}+((R_{max}-R_{min})*(D_{min\ \%}/2))$$

The minimum difference $D_{min\ \%}$ expected in the response voltage is split (i.e., divided by 2) to share the noise margin between the dry condition case and the wet condition case.

Figure 13:
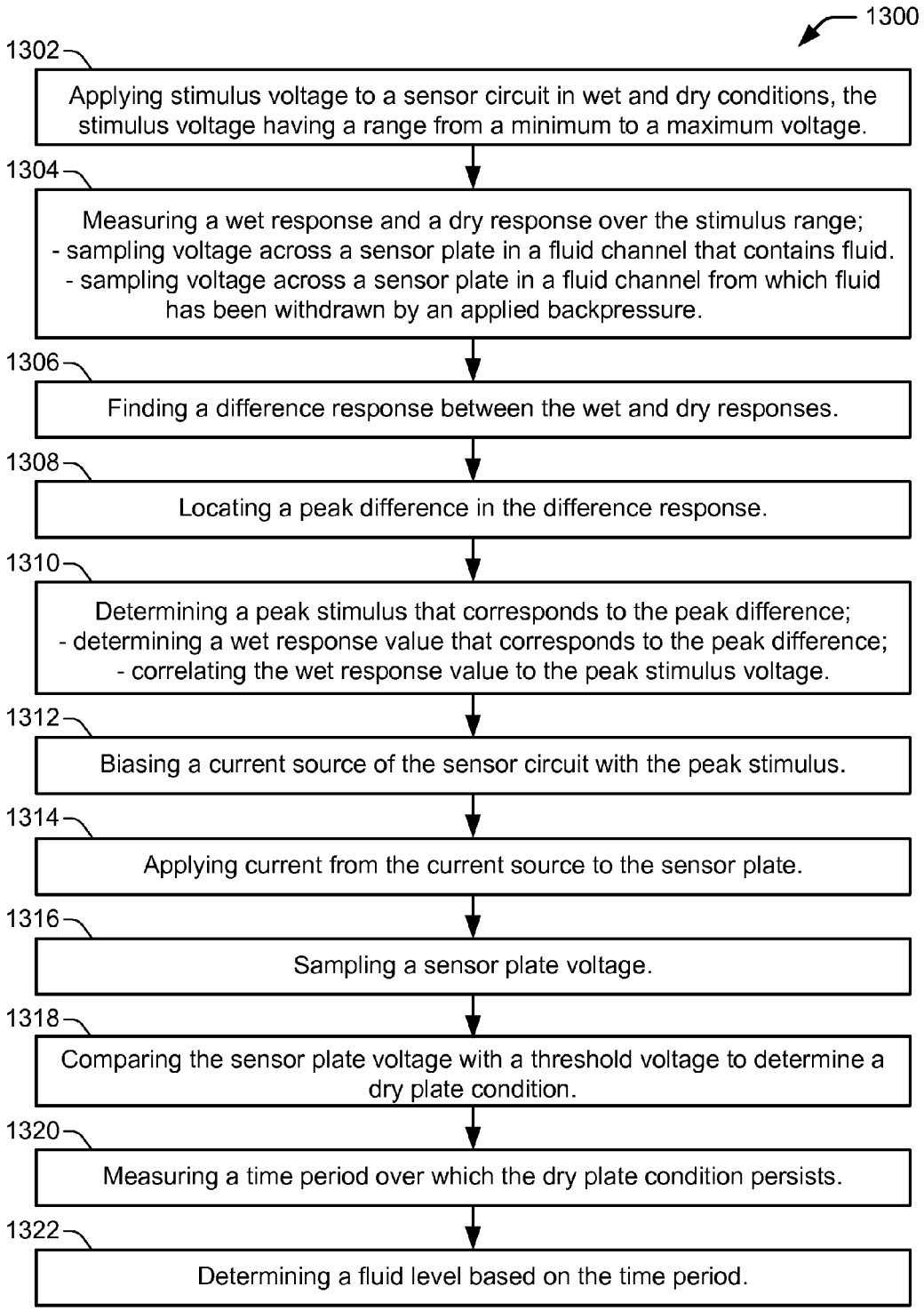
FIGS. 13 and 14 show flowcharts of example methods of sensing a fluid level, according to embodiments.

FIG. 13 shows a flowchart of an example method 1300 of sensing a fluid level, according to an embodiment of the disclosure. Method 1300 is associated with the embodiments discussed above with respect to FIGS. 1-12. Method 1300 begins at block 1302, with applying stimulus voltage to a sensor circuit in wet and dry conditions. The applied stimulus voltage has a range from a minimum to a maximum voltage. At block 1304, a wet response and a dry response are measured over the stimulus range. The measuring includes sampling voltage across a sensor plate in a fluid channel that contains fluid, and sampling voltage across a sensor plate in a fluid channel from which the fluid has been withdrawn by an applied backpressure. The method 1300 continues at block 1306 with finding a difference response between the wet and dry responses, and at block 1308 a peak difference in the difference response is located. At block 1310, a peak stimulus that corresponds to the peak difference is determined. This step includes determining a wet response value that corresponds to the peak difference, and correlating the wet response value to the peak stimulus voltage. At block 1312 of method 1300, a current source of the sensor circuit is biased using the peak stimulus, and at block 1314, current from the current source is applied to the sensor plate. At block 1316, a voltage response across the sensor plate is sampled. The sensor plate voltage is compared with a threshold voltage at block 1318 to determine a dry plate condition, and the time period over which the dry plate condition persists is measured at block 1320. At block 1322 of method 1300, a fluid level is determined based on the time period.

Figure 14:
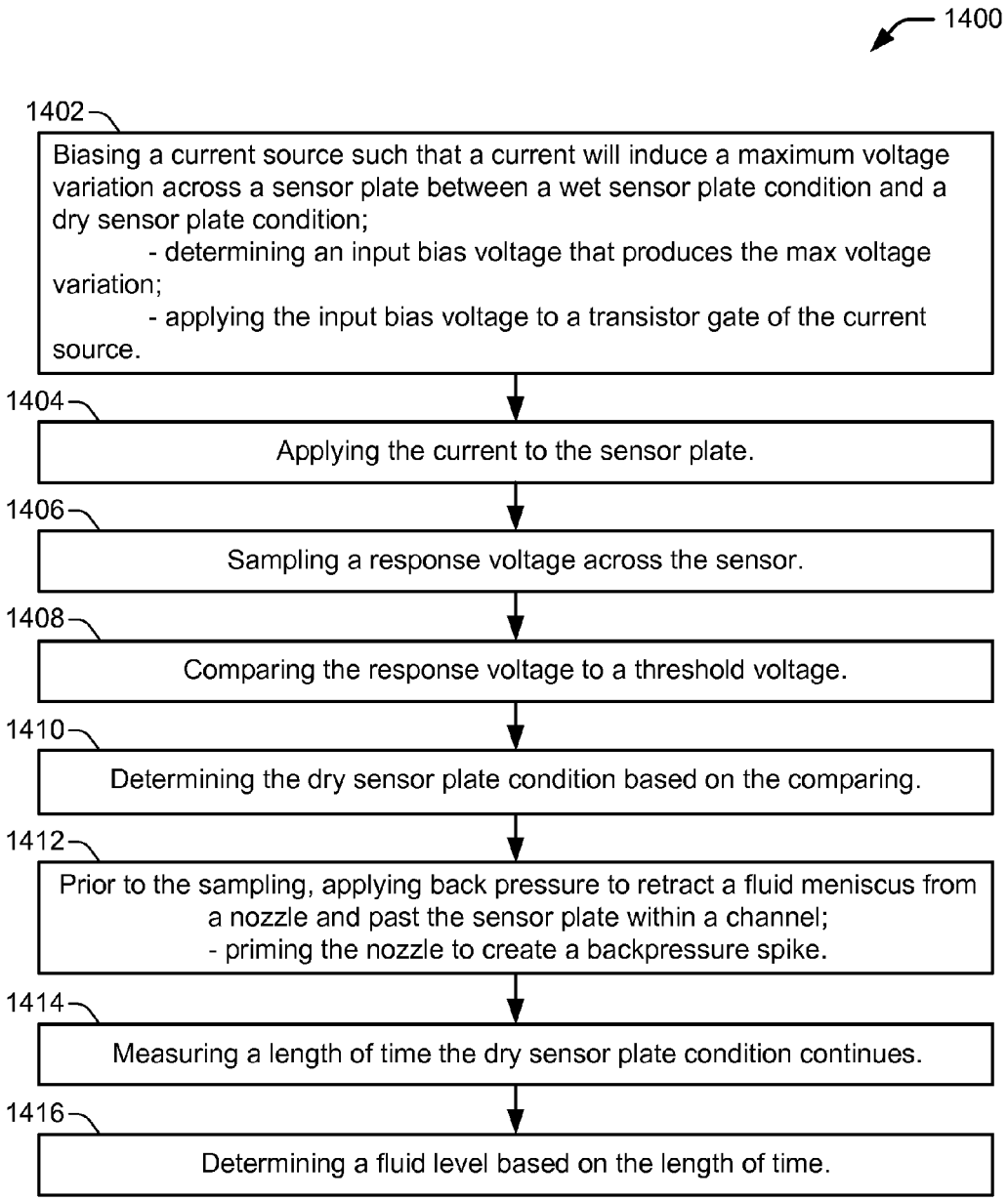

FIG. 14 shows a flowchart of another example method 1400 of sensing a fluid level, according to an embodiment of the disclosure. Method 1400 is associated with the embodiments discussed above with respect to FIGS. 1-12. Method 1400 begins at block 1402, with biasing a current source such that current from the current source will induce a maximum voltage variation across a sensor plate between a wet sensor plate condition and a dry sensor plate condition. Biasing the current source includes determining an input bias voltage that produces the maximum voltage variation and applying the input bias voltage to a transistor gate of the current source. Finding the input bias voltage includes applying a range of stimulus to the current source from a minimum stimulus voltage to a maximum stimulus voltage for both the wet sensor plate condition and the dry sensor plate condition. Applying the stimulus includes applying an 8-bit number ranging from zero to 255 to a DAC, and providing the output from the DAC as the 8-bit number multiplied by an analog voltage (e.g., 1 mV, 10 mV, 100 mV). Finding the input bias voltage also includes determining a wet condition voltage response and a dry condition voltage response across the sensor plate over the range of stimulus, determining a difference response between the wet condition voltage response and the dry condition voltage response, determining a peak difference response from the difference response, and locating a peak stimulus voltage that produces the peak difference response.

At block 1404 of method 1400, the current produced from the biased current source is applied to the sensor plate, and at block 1406 a response voltage across the sensor is sampled. The response voltage is compared with a threshold voltage at block 1408 to determine a dry plate condition as shown at block 1410. At block 1412, prior to the sampling, back pressure is applied to retract the meniscus from the nozzle and past the sensor plate within a fluidic channel. The back pressure is applied through priming the nozzle which creates a backpressure spike. At block 1414, the length of time that the dry sensor plate condition continues is measured, and at block 1416 a fluid level in the reservoir is determined based on the length of time.

What is claimed is:

1. A fluid level sensor comprising:

a nozzle;

a fluid channel;

a sensor plate on a floor of the channel;

a current source coupled to the sensor plate to induce a voltage across the sensor plate; and a sensor circuit to determine a voltage response of the sensor plate to the current source, the voltage response indicating whether fluid is present on the sensor plate.

2. A sensor as in claim 1, the sensor circuit further comprising a state machine to initiate a nozzle priming event, wherein the sensor circuit determines the voltage response during the nozzle priming event.

3. A fluid level sensor as in claim 1, wherein the sensor circuit determines an ink level based on a measured time period during which the voltage response of the sensor plate indicates a dry condition in the fluid channel.

4. A fluid level sensor as in claim 1, the sensor circuit comprising an electronic controller programmed to determine a bias for the current source such that the induced voltage across the sensor plate has a maximum differential voltage response between wet and dry sensor plate conditions.

5. A fluid level sensor as in claim 2, the sensor circuit further comprising: an input register; and a digital to analog converter (DAC) to receive an input code from the input register and provide a bias voltage to bias the current source.

6. A sensor as in claim 5, the sensor circuit further comprising an input sample and hold to sample the bias voltage from the DAC and apply the bias voltage to the current source.

7. A sensor as in claim 6, the sensor circuit further comprising a switch to short out the sensor plate in a closed position during biasing of the current source, and to apply current from the current source to the sensor plate in an open position.

8. A sensor as in claim 5, wherein the current source comprises three current producing transistors to produce current in three different current ranges.

9. A sensor as in claim 8, wherein the current source further comprises a range select circuit to apply voltage from the DAC to one of the three current producing transistors.

10. A sensor as in claim 1, the sensor circuit further comprising an output sample and hold to sample an analog response voltage at the sensor plate.

11. A sensor as in claim 10, the sensor circuit further comprising an analog to digital converter (ADC) to convert the analog voltage response to a digital value.

12. A sensor as in claim 11, the sensor circuit further comprising: an output register to store the digital value.

13. An inkjet printhead comprising the fluid level sensor of claim 1, the printhead further comprising:

a fluid slot, and the fluid channel disposed to fluidically couple the nozzle to the fluid slot.

14. An inkjet printhead as in claim 13, further comprising: a DAC to convert an input code into a bias voltage to bias the current source; and an input sample and hold element to sample the bias voltage from the DAC and apply it to the current source.

15. An inkjet printhead as in claim 14, further comprising an ADC to convert the voltage response to a digital value.

16. An inkjet printhead as in claim 15, further comprising: an input register to provide the input code to the DAC; and an output register to store the digital value.

17. An inkjet printhead as in claim 15, further comprising a switch to short out the sensor plate in a closed position during biasing of the current source, and to apply current from the current source to the sensor plate in an open position.

18. An inkjet printhead as in claim 17, further comprising a state machine to control the switch, the sample and hold elements, the DAC, and the ADC.

* * * * *